US005205563A

United States Patent [19]

Dearing

[11] Patent Number: 5,205,563

[45] Date of Patent: Apr. 27, 1993

[54] CARD GAME

[76] Inventor: Albin P. Dearing, 2027 Bolsover St., Houston, Tex. 77005

[21] Appl. No.: 703,182

[22] Filed: May 20, 1991

[51] Int. Cl.[5] ..... A63F 1/02

[52] U.S. Cl. ..... 273/296; 273/302; 273/307; 434/130

[58] Field of Search ..... 273/296, 302, 307, 308, 273/298, 292, 273; 434/129, 130

[56] References Cited

U.S. PATENT DOCUMENTS

| | | | |
|---|---|---|---|
| 1,267,947 | 5/1918 | Whiteside | 273/292 X |
| 1,327,019 | 1/1920 | Britton | 273/296 |
| 1,489,541 | 4/1924 | Miller | 273/302 |
| 1,745,946 | 2/1930 | Murray | 434/130 X |
| 2,138,524 | 11/1938 | Harkins | 273/302 X |

FOREIGN PATENT DOCUMENTS

| | | | |
|---|---|---|---|
| 1601216 | 10/1981 | United Kingdom | 434/129 |

*Primary Examiner*—Richard J. Apley

*Assistant Examiner*—Karen Jalbert

*Attorney, Agent, or Firm*—Harrison & Egbert

[57] ABSTRACT

A card game which includes a plurality of cards. Each of the plurality of cards has a front side and a back side. The front side has a first identification information section printed thereon. A first name information section is printed below the identification information section on the front side of the card. The first identification information section has information corresponding to said first name information section on another of the cards. The back side of the card has a second name information section printed thereon. The second name information section has information corresponding to the first identification information section. The back side of the card also has a leader information section at a different location than the second name information section. The leader information section has information corresponding to the second name information section on another of the plurality of cards.

18 Claims, 3 Drawing Sheets

CARD GAME

TECHNICAL FIELD

The present invention relates to playing cards, in general. More particularly, the present invention relates to card games that are used for educational purposes.

BACKGROUND ART

For centuries one of man's principal social and intellectual diversions, cards and card games, fit every degree of skill, from the simplest children's games to advanced games requiring inferential reasoning of a high order, psychology, and speculation. Card games remain popular despite the proliferation of other forms of entertainment, and cards are also used for education, divination, and conjuring.

Though where and when cards originated is uncertain, China seems to be the most likely place, and the 7th to the 10th century the earliest probable time. An Indian origin has been suggested by the resemblance of symbols on some early European decks to the ring, sword, cup, and baton classically depicted in the four hands of Hindu statues. Yet another theory is that both cards and chests are derived from ancient divinatory procedures used by primitive peoples.

It is not known how cards were introduced to Europe. Some early decks had symbols resembling the Chinese markings and may have been taken back by a Venetian, possibly Niccolo Polo or his more famous Son Marco during travels to and from China in the latter half of the 13th century. Another speculation is that cards may have been brought from Arabia by the Gypsies, but the Gypsies did not reach Western Europe in appreciable numbers until after cards had been more firmly established. If an Arab origin is to be sought, the Saracen invasion of Sicily or the Moorish Conquest of Spain could provide a link. The Spanish word for cards, which is naipes, and an earlier Italian word, which is naibi, are probably of Arab origin. There are references to cards in Italy from 1299, in Spain, from as early as 1371, the Low Countries, from 1379, and in Germany from 1380. A French manuscript of the early 14th century contains a reference to cards, and in 1392 the registers of the Chambre des Comptes of Charles VI recorded the purchase of three games of cards "in gold and diverse colors". In England by 1465 the use of cards was well enough established for manufacturers to petition for protection against imports.

Card games catering to social and competitive inclinations have proved vastly more important than other uses of cards. It is frequently suggested that one prime ingredient of their success is that such games allow women to compete with men on equal terms and in mixed society. From the earliest times, cards have been used for instruction in diverse subjects. A cardinal, for example, used playing cards each baring a full-length figure with a description below, to instruct the young Louis XIV in the names of the kings and queens of France, geography, and Greek myths. Heraldry was also a popular subject for instruction by cards. Today there are many games, played mainly by children, based on the assembly of sets of pictures, while other decks—printed with the letters of the alphabet—or used for word games by adults as well as children.

The games for children are necessarily simple, as they must appeal to all age groups, and are seldom played in a serious frame of mind. Children enjoy them because they can compete with adults with a chance of winning. Most can be played by any reasonable number, and many games accentuate the element of suspense by giving each player three lives, after losing which he is out. Some games introduce actions, such as Slapjack, in which the player who slaps the jack when it appear takes all of the cards in a common pile. Some have an educational value, such as Casino, which is a foremost children's game because it gives practice in elementary arithmetic and can be played at a more serious level by adults. Other popular games are Old Maid and Beggar-My-Neighbor. Older children quickly learn to outshine most adults in such games as Concentration (Memory, Pelmanism in which, on each turn, the player faces two cards from a complete deck laid out face down. If a pair is formed, the player keeps them; if not, they are returned to their places, again face down. The winner is the player who collects the most cards.

The game of Concentration is very important in developing the memory skills of children. As such, the game of Concentration can be adapted, in other ways, to increase the understanding of geography or other important topics. In addition, when used with the names of football players, emphasis can be placed on the pattern in which football players attended college prior to playing professional football. As such, there is a need to adapt conventional playing cards so as to instill goals and to promote education among children.

It is an object of the present invention to provide a card game which is instructional and educational.

It is another object of the present invention to provide a card game that is simple, yet fun to play.

It is a further object of the present invention to provide a card game that is adaptable to a wide range of topics and subjects.

These and other objects and advantages of the present invention will become apparent from a reading of the attached specification and appended claims.

SUMMARY OF THE INVENTION

The present invention is a card game that comprises a plurality of playing cards. Each of the playing cards has a front side and a back side. The front side of the playing cards have a first identification information section printed thereon. The front side also has a first name information section printed thereon in a different location than the first identification information section. The first name information section corresponds in subject matter with a first identification information section on another of said plurality of cards. The back side of the playing cards have a second name information section printed thereon. This second name information section has information which corresponds in subject matter to the first identification information section of the front side of the same card. The back side also has a leader information section at a different location than the second name information section. The leader information section has information that corresponds in subject matter to the first identification information section on another of the plurality of cards.

The first identification information section is positioned adjacent the top of the card. The first name information section is positioned adjacent the bottom of the card. The second name information section is positioned adjacent the top of the back of the card. The second name information section is aligned with the position of the first identification information section.

The leader information section is positioned adjacent the bottom of the back side of the card. This section is aligned with the position of the first name information section.

Each of the cards has a numerical value positioned in the upper right hand corner of the card. The plurality of cards comprise fifty-six cards or less in the deck.

The present invention further includes a first clue section that is located on the front side of the card between the first identification information section and the first name information section. A second clue section is placed on the back side of the card between the second name information section and the leader information section.

DETAILED DESCRIPTION OF THE INVENTION

Figure 1:
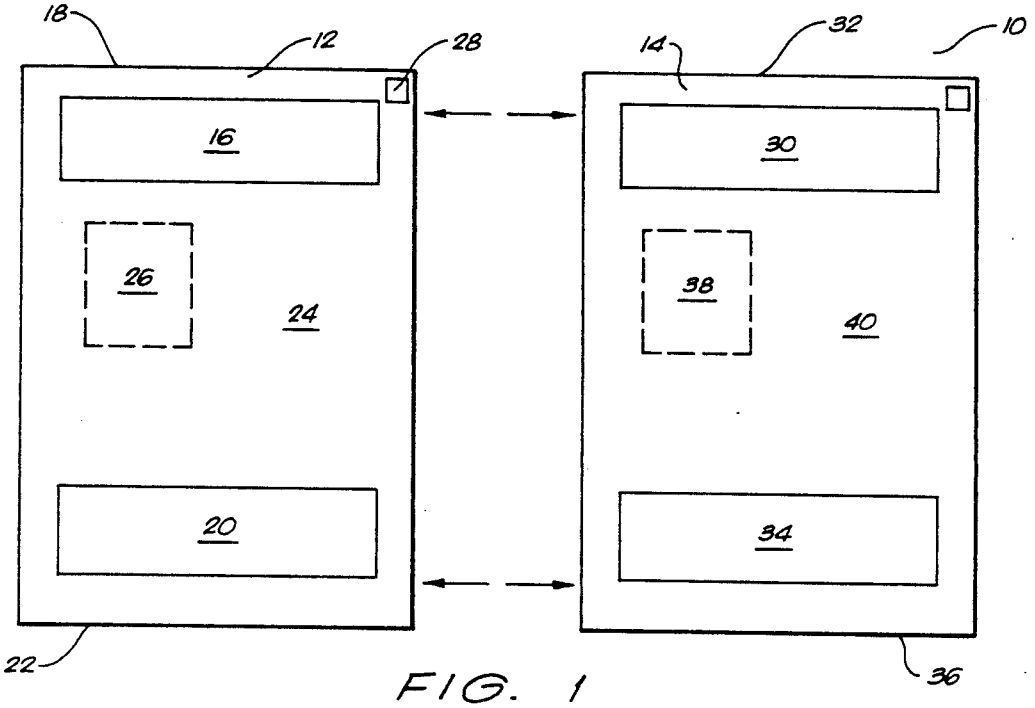
FIG. 1 is a front side/back side schematic illustration of the playing card in accordance with the present invention.

FIG. 1 shows the front side and back side view of a single car 10 prepared in accordance with the teachings of the present invention. Playing card 10 has a front side 12 and a back side 14. The front side has a first identification information section 16 printed thereon. This first identification information section is located slightly below the top edge 18 of front side 12. The identification information section 16 extends generally parallel to the top edge and is presented in a manner so that the user of the card can easily view the information printed on the information identification section 16. The front side 12 of playing card 10 also has a first name information section 20 printed thereon. The first name information section 20 is printed adjacent to the bottom edge 22 of the playing card 10. This first name information section 20 is presented so as to extend parallel to the bottom edge 22 and below the first identification information section 16. The first name information section 20 will contain information which corresponds in subject matter to information in the first identification information section 16 on another of the plurality of cards. The front side 12 also includes an open area 24 extending between the first identification information section 16 and the first name information section 20. The open area 24 can accommodate all types of printed information or game identification information. The information printed in space 24 generally has nothing to do with the information provided in sections 16 or 20. A first clue section 26 is printed on the front side 12 of card 10. First clue section 26 generally has information relating to the information contained in the first identification information section 16. In actual use, the clue section 26 will assist the user in determining the proper response to the information contained in section 16. The first clue section 26 is positioned in a generally rectangular box between the first identification information section 16 and the first name information section 20. Finally, in the upper right hand corner of the front side 12 of card 10 is a numerical value indicator 28. Numerical value indicator 28 provides the user of the card with some information concerning the sequence number of the card in a series or information as to the value of the card in relation to any other cards. This space is reserved for providing information to the user of any other numerical value that might be of use in the playing of the game.

It can be seen that the card 10 has a generally rectangular configuration. The card 10 is opaque. The card should be plastic coated so as to preserve the life of the game. In general, the plurality of cards consists of fifty-six or less cards.

The back side 14 has a configuration somewhat similar to the configuration of the front side 12 of card 10. However, the back side 14 includes information that is different than that presented on the front side 12. The information presented on the back side 14 of card 10 enhances the ability to use this card, and any others, as part of an overall game.

It can be seen that the back side 14 includes a second name information section 30 positioned generally adjacent to the top edge 32 of the back side 14 of card 10. The second name information section extends across the top edge 32 so as to present strong visual information to the user. The second name information section 30 is aligned with the position of the first identification information section 16 of the front face 12 of card 10. The back side 14 of card 10 further includes a leader information section 34. The leader information section 34 contains additional information that is not related to the information presented on the front side 12 of the card. The leader information section 34 is positioned adjacent to the bottom edge 36 of card 10. The leader information section 34 does have information which corresponds in subject matter to the second name information section on another of the plurality of cards in the game. A second clue section 38 is positioned between the second name information section 30 and the leader information section 34. The second clue section 38 may have information which is identical to the information contained in the first clue section 26 on the front face 12 of card 10. An open space 40 is also presented on the back side 14 of card 10 so as to provide any additional information to the user as would be required by the game. It should be kept in mind, however, that the first clue sections 26 and 38 are not critical to the functioning of the present invention. The clue sections 26 and 38 may enhance the enjoyment and use of the game. However, the inclusion of the clue sections 26 and 38 should not be taken as a limitation on the scope of the present invention. Additional clue sections can be placed in other locations on the cards.

Figure 2:
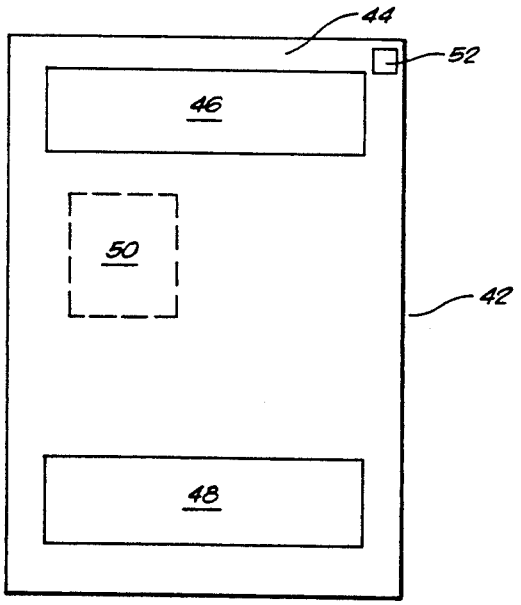
FIG. 2 is a front side view of another playing card in accordance with the present invention.

FIG. 2 illustrates another card 42 of the plurality of cards which are used in the game of the present invention. The card 42 is shown with its front face 44 appearing to the user. The front face 44 of card 42 has an appearance somewhat similar to that of the front face 12 of card 10. However, the card 42 has a first identification information section 46. This first identification information section 46 contains information that corresponds in subject matter to the information contained in the first name information section 20 of card 10. In a different game, with the cards "face down", the information contained in leader information section 34 of card 10 will correspond with the second name information section 46 of card 42. In the configuration illustrated in FIGS. 1 and 2, it can be seen how the bottom line of each face of the card can "lead" to the next card. The card 42 also includes a first name information section 48 and a clue information section 50. A suitable numerical value 52 may be included in the upper right hand corner of card 42.

Figure 3:
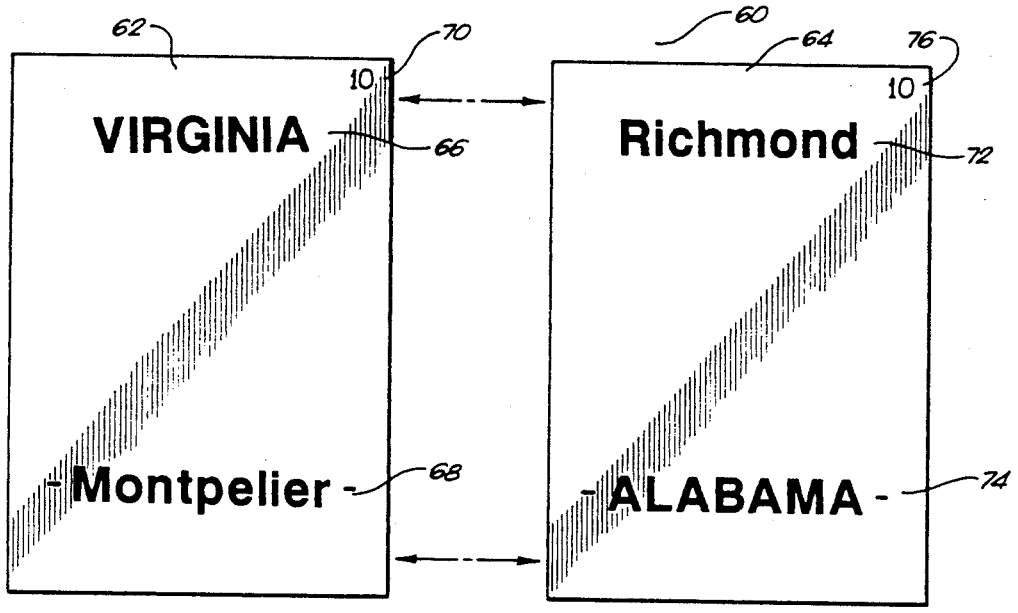
FIG. 3 is a front side/back side view of a single card of a game in accordance with the present invention.

FIG. 3 shows a basic embodiment of a single card 60 as used in a particular game. As can be seen, the card 60 has a front face 62 and a back face 64. The front face 62 has the word "VIRGINIA" positioned in the location of the first identification information section 66. At the bottom of the card, the word "Montpelier" is positioned where the first name information section 68 would occur. A numerical value 10 is shown at 70 in the upper right hand corner of the front face 62 of card 60. The numerical value 10 corresponds to the order in which the states were admitted into the Union.

The back face 64 of card 60 is representative of the configuration of the back side of the card described in conjunction with FIG. 1. Specifically, the back side 64 includes the word "Richmond" positioned in the area 72 for the second name information section. As can be seen, the word "Richmond" corresponds to the word "VIRGINIA" as being the capital of Virginia. As such, the first identification information section 66 will correspond with the second name information section 72.

During play, the second name information section verifies the correctness of the answer to the first identification information section. If a correct answer is reached, that is, the capital "Richmond" is identified as the capital of "VIRGINIA", then the user uses the word "Montpelier", in the first name information section 68, to guide the user to the next card. The back side 64 of card 60 also includes a numerical value "10" located at 76 in the upper right hand corner of card 60. As can be seen, the numerical value at 76 corresponds to the numerical value at 70. As such, FIG. 3 is illustrative of a single card in a single game using the concept of the present invention.

When the card game is reversed in its "face down" condition, then the word "Richmond" will appear in the second name information section 72. The word "VIRGINIA" at 66 confirms when a correct answer is given. The word "ALABAMA" at 74 will provide the clue as to the choice of the next card (having "Montgomery" in the second name information section on another card).

Figure 4A:
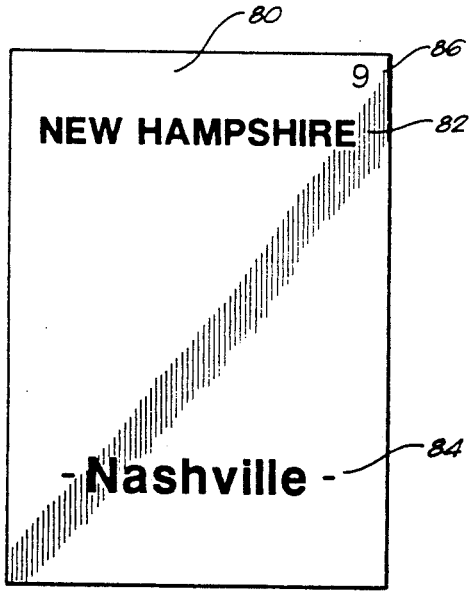
FIG. 4A–B are separate views of different cards of the same game as illustrated in FIG. 3.
Figure 4B:
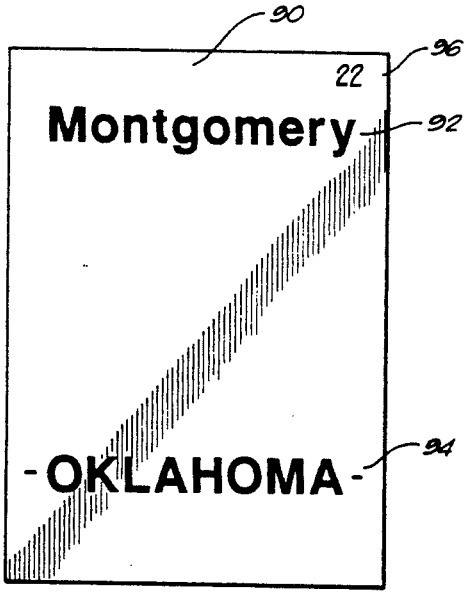

FIG. 4A and FIG. 4B illustrate additional cards which are used in the game identified in FIG. 3. FIG. 4A shows the card 80 which has the state name "NEW HAMPSHIRE" located in the first identification information section 82. The word "Nashville" is located in the first name information section 84. A numerical value of 9 is located in the upper right hand corner 86 of card 80.

FIG. 4B illustrates the back side of another card 90 which would be part of the game illustrated by the card of FIG. 3. Card 90 includes the state capitol "Montgomery" as located in the second name information section 92. The state name "OKLAHOMA" is located in the leader information section 94. A numerical value of "22" is located at 96 in the upper right hand corner of card 90.

During normal play of the game illustrated in FIGS. 3 and 4, the plurality of playing cards is initially shuffled. Each player will cut the deck of cards. The one cutting to the card having the lowest number in the numerical value indicator position 28 begins the play of the game. The cards have the numerical value in the order that each state was admitted to the Union. Since the first thirteen states were admitted simultaneously, these states are numbered in the order that they were ratified by the Constitution. After shuffling and cutting, all of the cards are displayed separately on the table with the front sides (with states identified at the top) displayed upwardly.

The first player picks up the card that he has cut to and reads the name identified on the first name information section 20. In the example shown in FIG. 3, the player will identify the name "Montpelier" in location 68 on the front face 62 of card 60. This means that the player must pick up the state card of which Montpelier is the capital (Vermont). With the example illustrated in FIG. 3, if the player chooses the card with "VIRGINIA" at the top, the player will expose the top of its back side 64 (showing the word "Richmond") to other players as proof that he has selected the correct card or showing that he has selected the wrong card. In this instance, the illustration of "Richmond", which does not coincide with "Montpelier" would indicate that the player has chosen the wrong card. If the player has selected the correct card, then the player will look at the name identified in the first name information section 20 so as to determine the next clue for the player. This "cues" the player to the next card to be chosen. If the player fails to match the correct card to its cue, the player must turn over the incorrectly selected card and leave it on the table. It becomes thus a bonus card to whatever player cued to it. The player must now pass to the next player the card whose cue he missed.

When the all of the state cards have been matched to their properly cued capitals, the cards are counted to determine the player's score thus far. The deck is again well shuffled and each card is laid out separately, this time with the capitol side 64 face up. Play is resumed with the object being to match the name in the leader information line 74 to its capitol identified in the second name information section 72. The player wins who correctly matches up the most cards. Eventually, the player will reach the point where he or she correctly matches the entire deck without pause. After this is accomplished, the object of the game can then be a race against the clock to see who can do this in the fastest manner possible.

Figure 5:
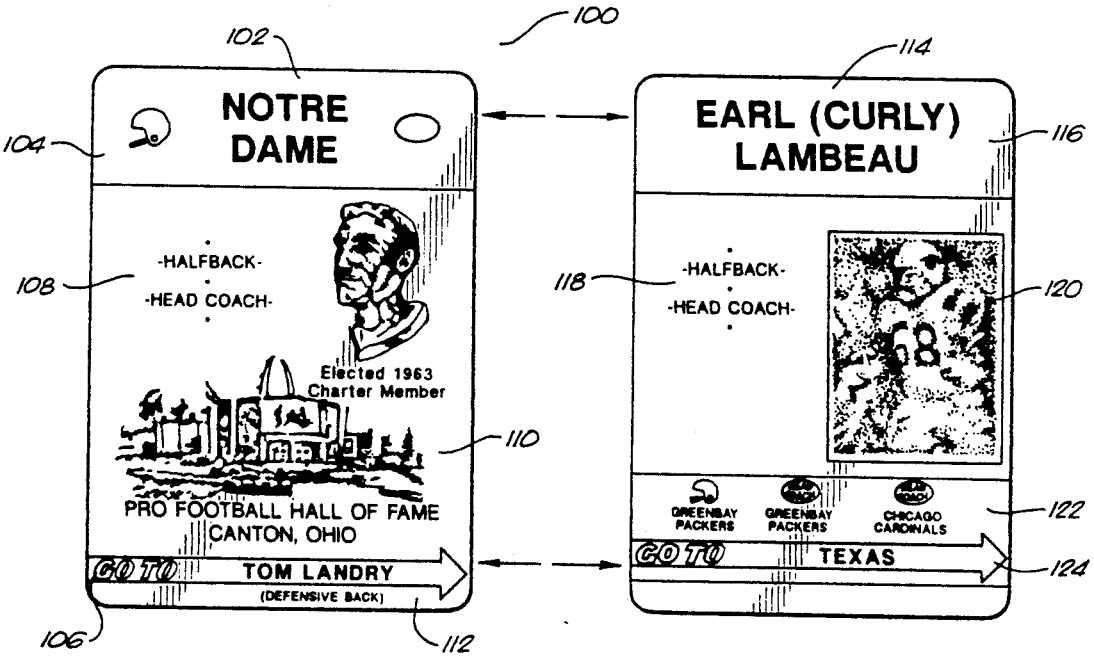
FIG. 5 is a front side/back side view of a single card in accordance with the present invention showing a different game than that of FIGS. 3 and 4.

FIG. 5 illustrates a card 100 showing a different variation of the game of the present invention. The game shown with the use of the card 100 is for the identification and matching of football players from the Football Hall of Fame with the colleges that they attended.

As can be seen on the front side 102 of card 100, the first identification information section 104 contains the name of the school "Notre Dame". The first name information section 106 contains the name "Tom Landry". The first name information section 106 will correspond to the first identification information section on another of the cards 100. The clue section 108 provides additional information concerning the Hall of Fame player that went to Notre Dame. It specifically identifies the person as being a "Halfback" and "Head Coach". The clue section 108 further indicates that the person was elected in 1963 as a "Charter Member" to the Hall of Fame. The remaining space 110 provides an illustration of the Hall of Fame. Another clue section 112 is located beneath the name found in the first name information section 106. This clue section 112 further identifies the position of the player located in the first name information section.

The back side 114 of card 100 has the name "Earl (Curley) Lambeau" positioned in the second name information section 116. From this card, it can be seen that the name in the second name information section 116 corresponds with the school found in the first identification information section 104 located on the front face 102 of card 100. The second clue section 118 has identical information as that contained in the first clue section 108. The back side 114 further includes a photograph 120 of the player identified in the second name information section 116. Additional information found in 122 on card 100 indicates the teams for which the player in the second name information section 116 played.

The leader section 124 is located at the bottom of the card. The leader information section 124 has the word "Texas" included therein. This word "TEXAS" will correspond with the name of a player identified in the second name information section on another of the cards.

During the play of the game shown in FIG. 5, the players initially shuffle the cards well. Each person cuts the deck. The person cutting to the highest numbered card will start the play using the card he has cut to. All of the cards are laid out separately on the table with their player side 114 upward. The starting player will pick up the card he has cut to and read the leader information section 124. In the card illustrated in FIG. 5, this will indicate "go to Texas". This line recites a particular college (or university).

The player must select from all the player cards displayed, the particular player who attended the college designated. For example, it will be necessary to find the player that went to "Texas". The person then picks up the player card of the Hall of Fame enshrinee who went to Texas. Adding this card to the cards in his hand, he shows, for others to see, its back side, at the first identification information section 102, the school name. This proves that he has selected the correct card.

The player again looks at the leader line 124 of the card he has now selected so as to see the next "cue". The player continues adding to his hand as long as he correctly matches up the cards to the leader line information 124. Should the player make a wrong selection, he has "fumbled", in which case he must turn over the fumbled card to show its reverse side. The player then passes on the card to the next player and challenges him to match it up.

As play continues, someone will pick up a card whose leader line 124 will send him to a "fumbled" card. This, since it names the player being sought, is a bonus, a recovered fumble, and he proceeds from the leader information line 124 on its player side, as before.

A hypothetical "halftime" is reached when all of the player cards have been matched with their respective colleges. The score is tabulated, the cards thoroughly shuffled, and now all laid out with their opposite sides showing face up. On these opposite sides, the colleges are identified in the first identification information section 102 and the players are identified in the first name information section 106. The object now is to find the college of the particular player designated in the first name information section 106.

In the scoring of the game each card counts ten yards toward a touchdown (six points). Hence, a player holding twenty cards has accumulated two hundred yards (two touchdowns) or twelve points. Each additional card in his hand, up to the number of touchdowns he has scored, gives him the extra one point after touchdown: i.e. if he holds twenty-two cards he has two touchdowns plus two extra points, and the score is fourteen. When a "Charter Member" of the Hall of Fame has been selected, the player holding any of these cards is accredited with a "field goal" for each Charter Member card, or three points. The "Charter Members" are designated in the clue sections 108.

When the participants of the game have become fairly expert at matching all of the cards correctly, play may be continued against the clock. In this game, the object is to see who can play the game fastest.

The games of the present invention provide an educational and entertaining experience for children and adults. The continued play of the game will give children a strong knowledge of the various states and state capitols. In addition, children will learn the names of football players, the names of colleges, and information pertaining to such players. An inference can be found that the children will soon identify that all great football players have once attended college. As such, this provides subtle encouragement to the children that college is an important goal.

Various games can be adapted from the format described herein. It is not the intention of the present invention to be limited to simply states and state capitols or to football players. Various games are possible using the configuration of cards and the manner of play identified in connection with FIGS. 1 and 2.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A card game comprising:

a plurality of cards, each of said cards having a front side and a back side, said front side having a first identification information section printed thereon, said front side having a first name information section printed thereon, said first identification information section and said first name information section positioned in different locations on said front side, said first name information section having information corresponding in subject matter to a first identification information section on another of said plurality of cards, said back side having a second name information section, said second name information section having information corresponding in subject matter to said first identification information section of said front side of same card, said back side having a leader information section printed thereon at a different location than said second name information section, said leader information section having information corresponding in subject matter to a second name information section on another of said plurality of cards.

2. The card game of claim 1, said first identification information section positioned adjacent a top of a card of said plurality of cards.

3. The card game of claim 2, said first name information section positioned adjacent a bottom of said card, said first name information section located below said first identification information section.

4. The card game of claim 3, said second name information section positioned adjacent the top of said card, said second name information section aligned with the position of said first identification information section.

5. The card game of claim 4, said leader information section positioned adjacent the bottom of said card, said leader information section aligned with the position of said first name information section.

6. The card game of claim 1, each of said cards having a numerical value positioned on said card.

7. The card game of claim 6, said numerical value being positioned adjacent an upper right hand corner of a front side of said card above said first identification information section.

8. The card game of claim 7, said numerical value being positioned in an upper right hand corner on a back side of said card above said second name information section, said numerical value on said back side being the same as said numerical value on said front side.

9. The card game of claim 8, said numerical value being indicative of the difficulty of the information.

10. The card game of claim 1, said plurality of cards comprising fifty-six or less cards.

11. The card game of claim 1, said front side of said card having a first clue section, said first clue section having information relating to said second name information section.

12. The card game of claim 11, said back side of said card having a second clue section, said second clue section having information relating to said first identification information section.

13. The card game of claim 12, said first clue section positioned between said first identification information section and said first name information section, said second clue section positioned between said second name information section and said leader information section.

14. The card game of claim 1, said first identification information section including the names of states, said first name information section including the names of state capitols, said first name information section including the names of state capitols corresponding to those names of states of said first identification information section on another of said plurality of cards, said leader information section including the names of states corresponding to the names of state capitols in said second name information section on another of said plurality of cards.

15. The card game of claim 1, said first identification information section including the names of state capitols, said first name information section including the names of states, said first name information section including the names of states corresponding to those names of state capitols of said first identification information section on another of said plurality of cards, said leader information section including the names of state capitols corresponding to the names of states identified in said second name information section on another of said plurality of cards.

16. The card game of claim 1, said first identification information section including the names of colleges, said first name information section including the names of individuals, said first name information section including the names of individuals related to the names of colleges of said first identification information section on another of said plurality of cards, said leader information section including the names of colleges corresponding to the names of colleges identified in said second name information section on another of said plurality of cards.

17. The card game of claim 1, said first identification information section including the names of individuals, said first name information section including the names of colleges, said first name information section including the names of colleges related to the names of individuals of said first identification information section on another of said plurality of cards, said leader information section including the names of individuals corresponding to the names of individuals of said second name information section on another of said plurality of

18. The card game of claim 1, each of said plurality of cards being opaque.

* * * * *